US008061068B1

(12) United States Patent
Donovan

(10) Patent No.: US 8,061,068 B1
(45) Date of Patent: Nov. 22, 2011

(54) NURSING BRA BREAST FEEDING INDICATOR

(76) Inventor: Sandra M. Donovan, Upland, CA (US)

( * ) Notice: Subject to any disclaimer, the term of this patent is extended or adjusted under 35 U.S.C. 154(b) by 0 days.

(21) Appl. No.: 12/613,425

(22) Filed: Nov. 5, 2009

(51) Int. Cl.
*G09F 21/02* (2006.01)

(52) U.S. Cl. ..... 40/586; 63/1.11

(58) Field of Classification Search ..... 40/661.04, 40/586; 63/21, 23, 1.11; 450/39, 86; 24/3.4
See application file for complete search history.

(56) References Cited

U.S. PATENT DOCUMENTS

| | | | | |
|---|---|---|---|---|
| 4,423,734 | A | 1/1984 | Schawel | |
| 5,092,812 | A | 3/1992 | Babcock | |
| 6,146,239 | A * | 11/2000 | Magliocchetti | 450/1 |
| 6,170,127 | B1 * | 1/2001 | Lim | 24/3.4 |
| 6,241,575 | B1 * | 6/2001 | Shailer | 450/38 |
| 6,264,529 | B1 | 7/2001 | Logue | |
| 6,364,739 | B1 | 4/2002 | Dutka et al. | |
| 7,833,085 | B2 * | 11/2010 | Crouch | 450/86 |
| 2004/0007018 | A1 * | 1/2004 | Detsis | 63/21 |
| 2005/0166636 | A1 * | 8/2005 | Lazor | 63/38 |
| 2006/0037358 | A1 * | 2/2006 | Zuffoletto | 63/1.11 |
| 2007/0119810 | A1 * | 5/2007 | Boles | 215/365 |
| 2010/0154472 | A1 * | 6/2010 | Unitan | 63/1.11 |

FOREIGN PATENT DOCUMENTS

WO WO02/078474 10/2002

* cited by examiner

*Primary Examiner* — Casandra Davis
(74) *Attorney, Agent, or Firm* — Michael I. Kroll

(57) ABSTRACT

A decorative article that is attached to a nursing bra strap as an indicator of which breast an infant last fed from or will feed from next. The decorative article is suspended pendant like from a parrot clasp and is moved from a strap fastener on one nursing bra strap to the other as a nursing breast system indicator.

3 Claims, 8 Drawing Sheets

NURSING BRA BREAST FEEDING INDICATOR

BACKGROUND OF THE INVENTION

1. Field of the Invention

The present invention relates generally to indicators and, more specifically, to a decorative article that can be attached to a nursing bra strap as an indicator of which breast the infant last feed from or will feed from next. In either case, the decorative article can be moved from one nursing bra strap to the other as a nursing breast system indicator. Shown in the prior art, breast nursing system indicators are apparatus that are included as an integral part of the nursing bra. Also known in the prior art are systems as simple as using a safety pin selectively attached to the strap or cup as a breast feeding system indicator. Both of these methods are utilitarian in nature and do not disclose the use of a nursing breast indicator as a piece of jewelry or similar article that is desirous of public display. Furthermore, the instant invention's indicator can be treasured as an heirloom or placed on any bra strap or undergarment as an item of jewelry, as well as, a bikini thong.

2. Description of the Prior Art

There are other indicator devices designed for nursing bras. Shown in the prior art are breast nursing system indicators comprising apparatus that are included as an integral part of the nursing bra. Also known in the prior art are systems using a safety pin attached to the strap or cup as a breast feeding system indicator.

While these indicators may be suitable for the purposes for which they were designed, they would not be as suitable for the purposes of the present invention, as hereinafter described. Therefore it is felt that a need exists for a nursing bra breast feed indicator comprising releasably fastenable strap fasteners incorporating a releasably attachable decorative element that can be moved from one strap to the other as desired.

SUMMARY OF THE PRESENT INVENTION

A primary object of the present invention is to provide a nursing bra breast feeding indicator.

Another object of the present invention is to provide a nursing bra indicator designed for public display.

Yet another object of the present invention is to provide a nursing bra indicator having a parrot clasp with a lever for releasably fastening the decorative member from one fastening element on one bra strap to the other using only one hand.

Still yet another object of the present invention is to provide a nursing bra breast feed indicator wherein said pair of bra strap fasteners comprises a length of material having terminal ends each having a portion of a mating fastener whereby said strap fasteners can be looped around a respective bra strap and secured thereto.

A further object of the present invention is to provide a nursing bra breast feed indicator wherein said strap fasteners are looped around the bra strap and incorporate means for selectively attaching and detaching a decorative element therefrom.

A yet further object of the present invention is to provide a nursing bra breast feed indicator wherein said decorative element has a parrot clasp comprising a clasp portion, a hook portion and a release lever for separating the clasp from the hook.

A still yet further object of the present invention is to provide a nursing bra breast feed indicator wherein the hook portion is placed through the respective strap fastener element.

An additional object of the present invention is to provide a nursing bra breast feed indicator wherein said decorative element includes gemstones and crystals.

Another object of the present invention is to provide a nursing bra breast feed indicator that can be used with any bra.

Yet another object of the present invention is to provide a nursing bra breast feed indicator that can durably serve as an heirloom.

Still another object of the present invention is to provide a clasp with a decorative ornament for wear with an undergarment such as a thong.

A further object of the present invention is to provide a decorative ornament that can be worn on a thong, such as a bikini bottom.

Additional objects of the present invention will appear as the description proceeds.

The present invention overcomes the shortcomings of the prior art by providing a decorative article that can be attached to a nursing bra strap as an indicator of which breast an infant last fed from or will feed from next. The decorative article is suspended pendant like from a parrot clasp can be moved from strap fastener on one nursing bra strap to the other as a nursing breast system indicator. The present invention discloses the use of a nursing breast indicator as a piece of jewelry or similar article that is desirous of public display. Furthermore, the instant invention's indicator can be treasured as an heirloom or placed on any bra strap as an item of jewelry or worn on a thong, such as a bikini bottom.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
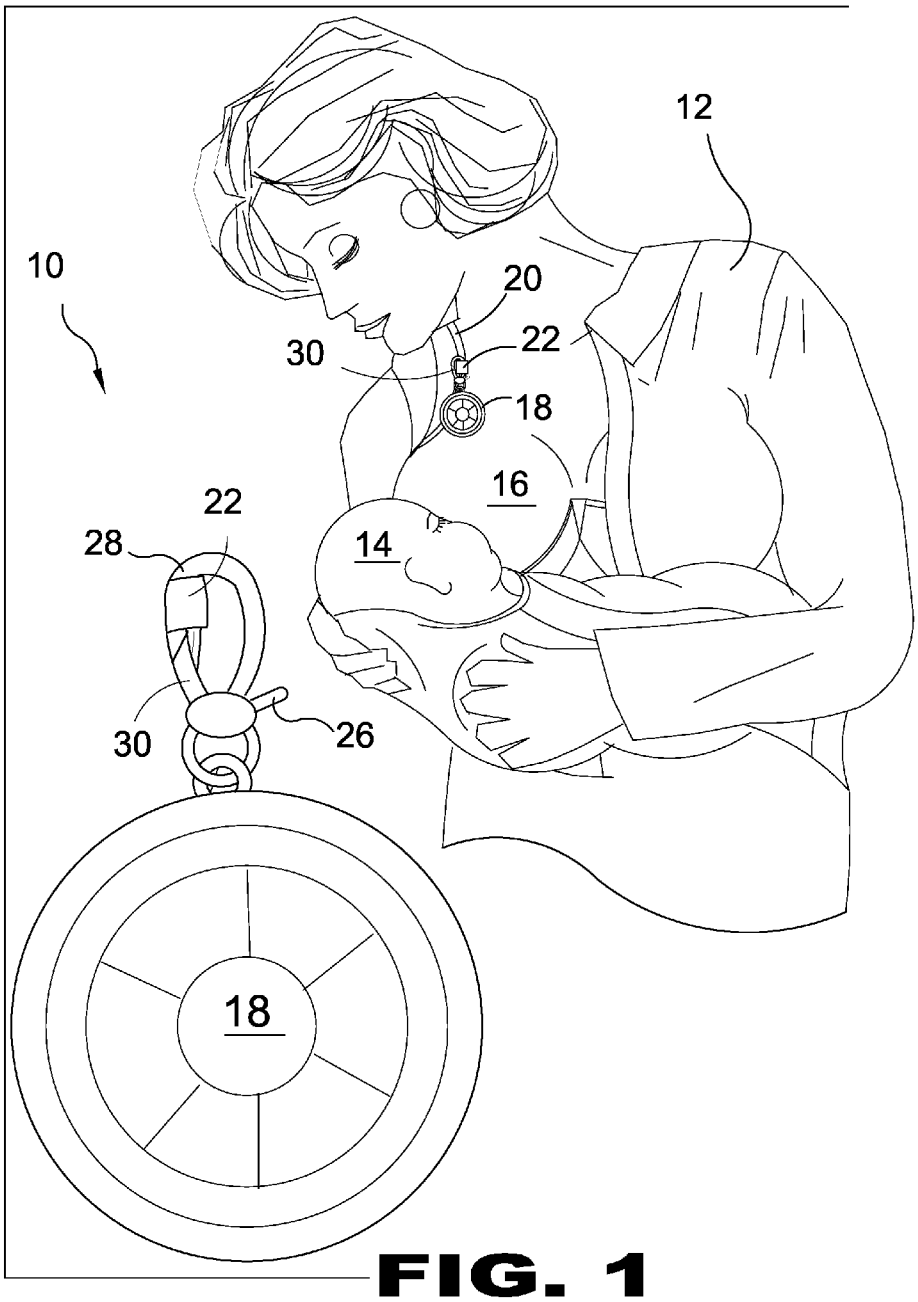
FIG. 1 is an illustrative view of the nursing bra breast indicator in use.

Turning now descriptively to the drawings, in which similar reference characters denote similar elements throughout the several views, the figures illustrate the Nursing Bra Breast Feeding Indicator of the present invention. With regard to the reference numerals used, the following numbering is used throughout the various drawing figures.

10 Nursing Bra Breast Feeding Indicator of the present invention
12 mother
14 baby
16 breast
18 decorative article
20 bra strap
22 releasable fastener element
24 parrot clasp
26 release trigger
28 hook portion of 24
30 clasp portion of 30
32 hook and loop fastener
34 thong

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the nursing bra breast indicator 10 in use. Lactating mothers 12 can breast feed a baby 14 every 2 to 3 hours until weaned to other foods as desired by the baby 14 or mother 12. The breasts 16 will continue to produce milk so long as nursing continues. Due to the repetitious nature of breast feeding the mother 12 can easily forget which breast 16 the infant 14 last suckled. The present invention provides a decorative article 18 that can be attached to a nursing bra strap 20 as an indicator of which breast 16 the infant 14 last fed from or will feed from next. In either case, the decorative article 18 can be moved from one nursing bra strap 20 to the other and secured thereto with a releasable strap fastener element 22 with a removable parrot clasp. There is one strap fastener 22 on each strap 20 to facilitate moving the indicator back and forth after each nursing session. Shown in the prior art, breast nursing system indicators are apparatus that are included as an integral part of the nursing bra. Also known in the prior art are systems as simple as using a safety pin selectively attached to the strap or cup as a breast feeding system indicator. Both of these methods are utilitarian in nature and do not disclose the use of a nursing breast indicator as a piece of jewelry or similar article that is desirous of public display. Furthermore, the instant invention's indicator 10 can be treasured as a lifelong keepsake or placed on any bra strap 20 as an item of jewelry.

Figure 2:
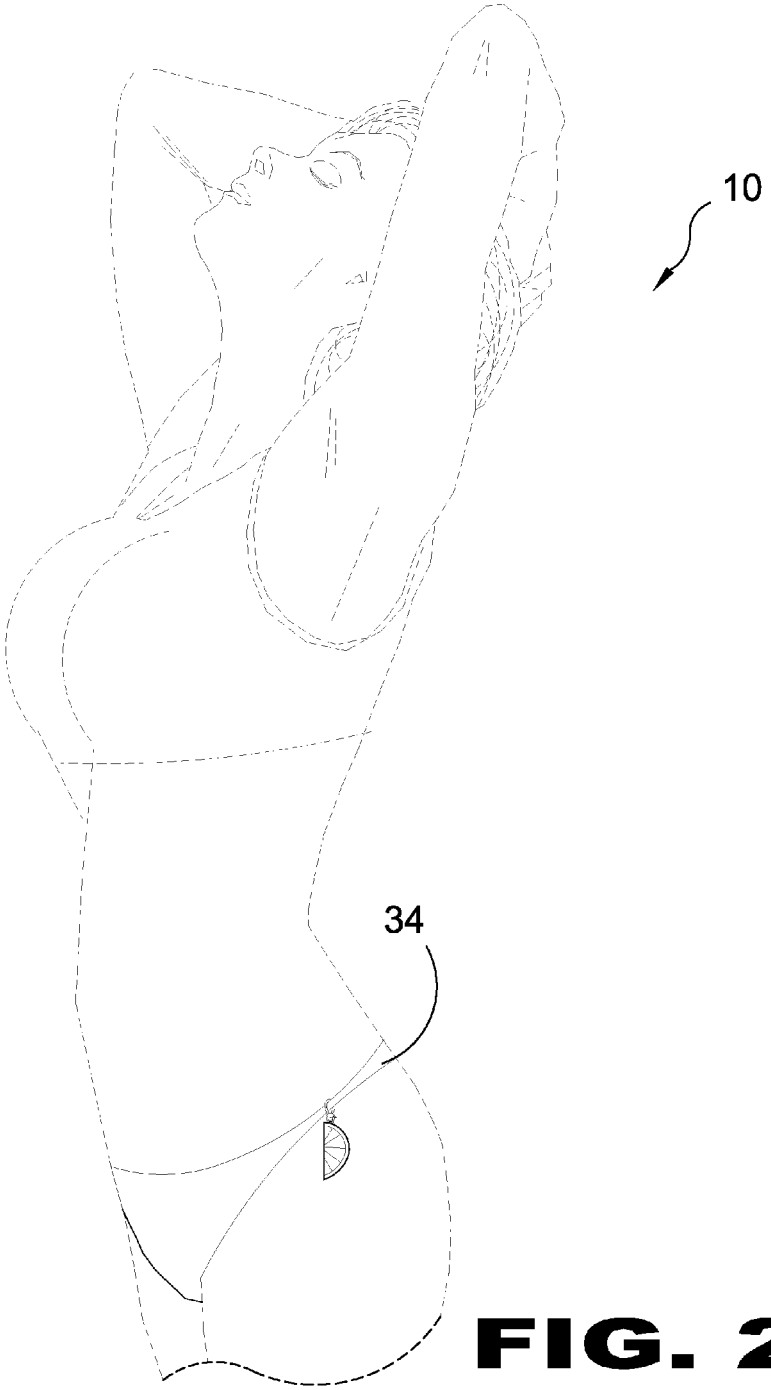
FIG. 2 is an illustrative view of the decorative ornament and clasp in use with a horizontal structure of thong underwear.

FIG. 2 is an illustrative view of the decorative ornament and clasp 10 in use with a horizontal structure of thong underwear or bikini bottoms 34.

Figure 3:
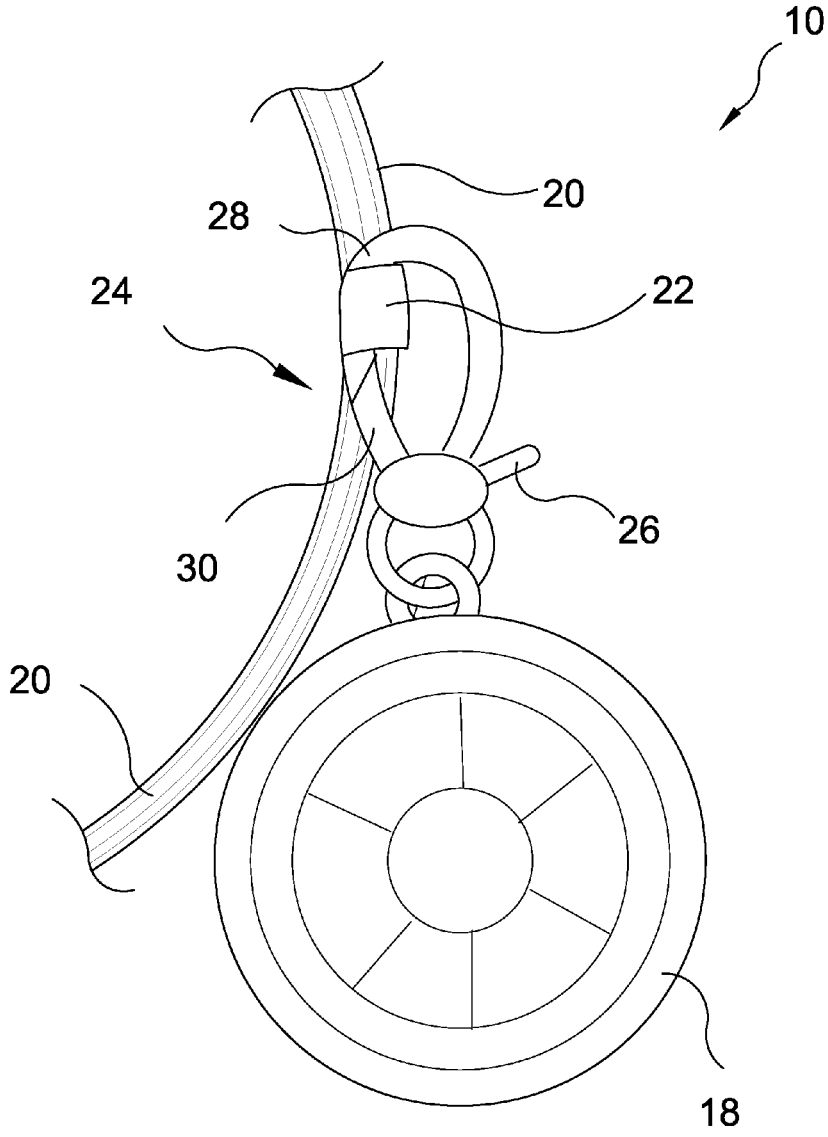
FIG. 3 is a detailed perspective view of the present invention 10 in use.

FIG. 3 is a detailed perspective view of the present invention 10 in use. Shown is the releasable fastener element 22 depicted as a parrot clasp 24 with attached decorative article 18 and secured to a bra strap 20. The parrot clasp 24 comprises a hook portion 28, a clasp portion 30 and a release trigger 26 that, when depressed, provides separation between the hook 28 and the clasp 30 that enables the user to remove it from the bra strap 20 easily with one hand and install it on the other.

Figure 4:
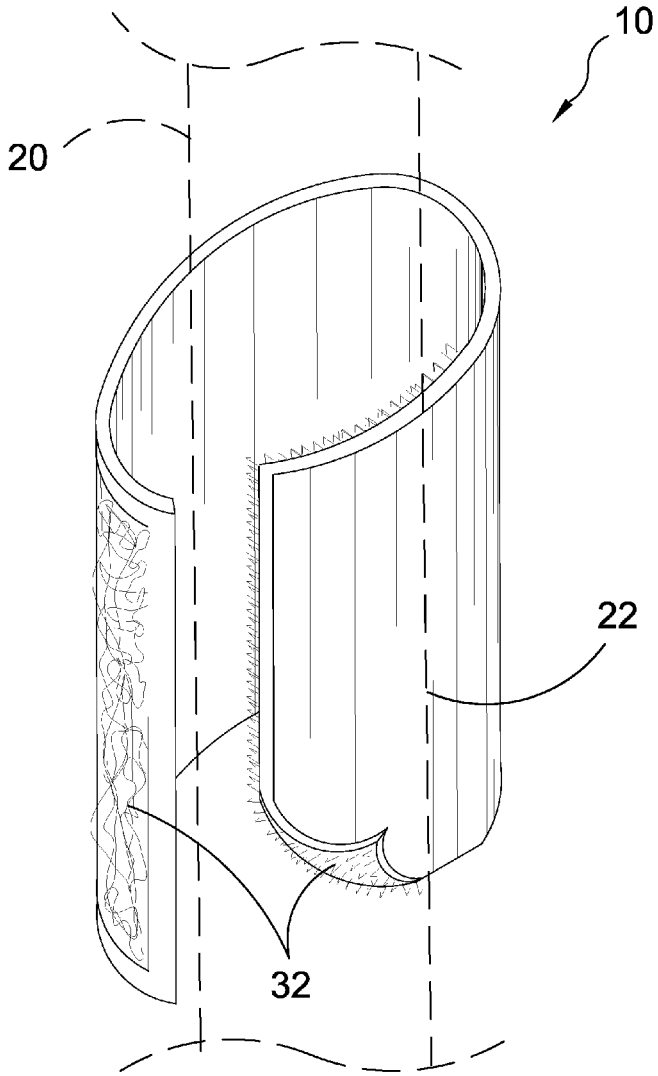
FIG. 4 is a perspective view of the releasable bra strap fastening element of the present invention.

FIG. 4 is a perspective view of the releasable bra strap fastening element 22 of the present invention 10. The fastening element 22 is looped around bra strap 20 and secured thereon by mating hook and loop fasteners 32. The decorative ornament is installed by placing the hook portion of the parrot clasp between the bra strap and the fastening element and releasing the trigger to close the clasp. Removal is achieved by simply reversing the procedure.

Figure 5:
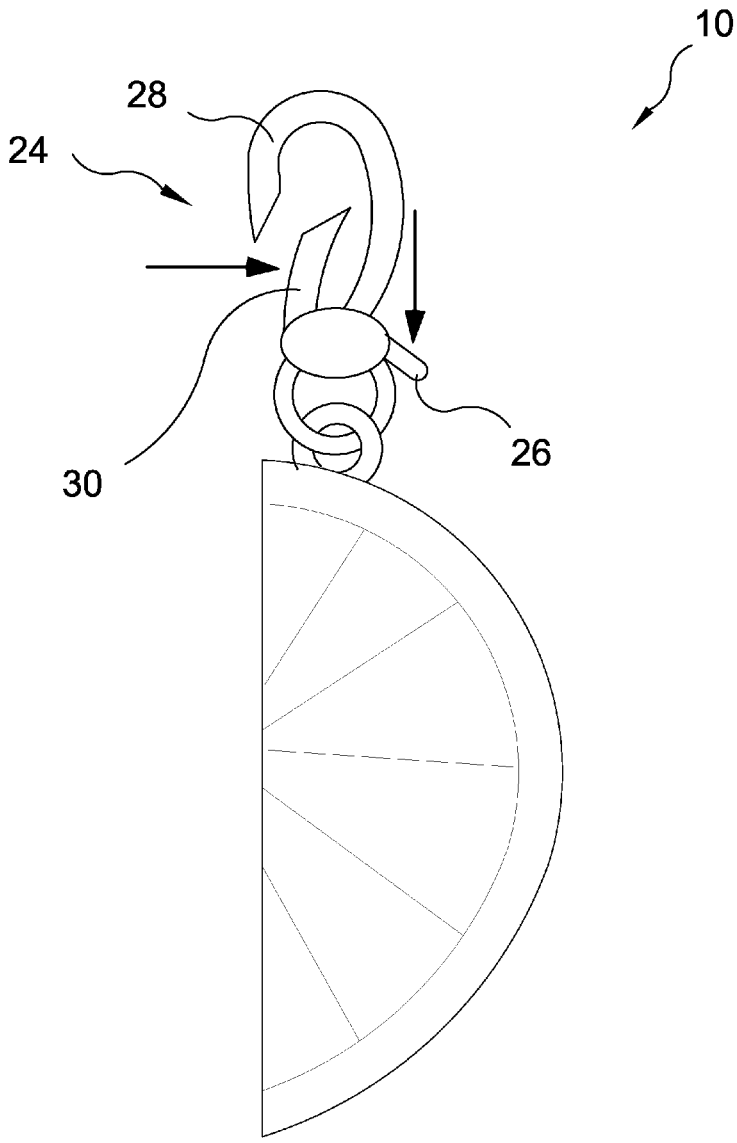
FIG. 5 is an illustrated view of the parrot clasp of the present invention.

FIG. 5 is an illustrated view of the parrot clasp 24 of the present invention 10 demonstrating the relation between the clasp portion 30 and the release lever 26 that when depressed provides separation between the hook 28 and the clasp 30 thus allowing the strap fastener element 22 to pass therethrough.

Figure 6:
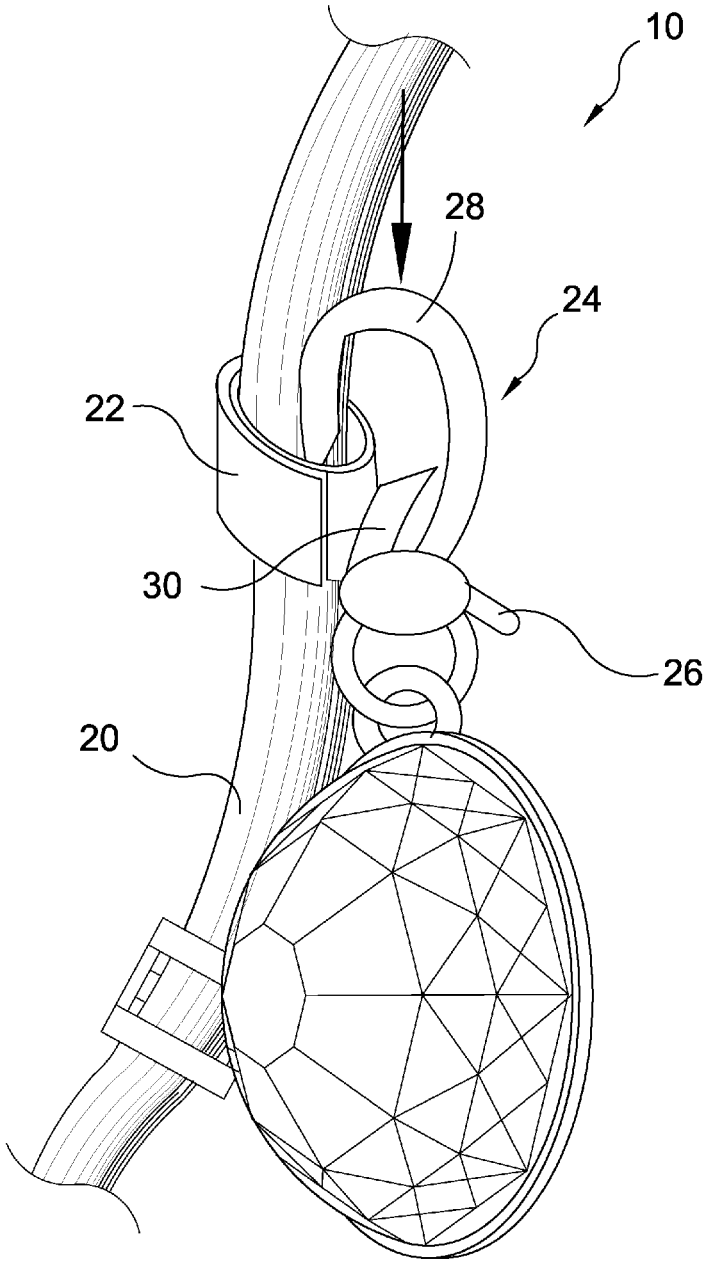
FIG. 6 is a perspective view of the strap fastening element of the present invention.

FIG. 6 is a perspective view of the strap fastening element 22 of the present invention 10. Shown is the fastening element 22 utilized in forming a connection with the bra strap 20 of a nursing bra by forming a loop around said strap 20. The clasp portion 30 of the parrot clasp 24 is open due to the depression of the release trigger 26 and the hook portion 28 is being inserted between the strap fastening element 22 and the bra strap 20.

Figure 7:
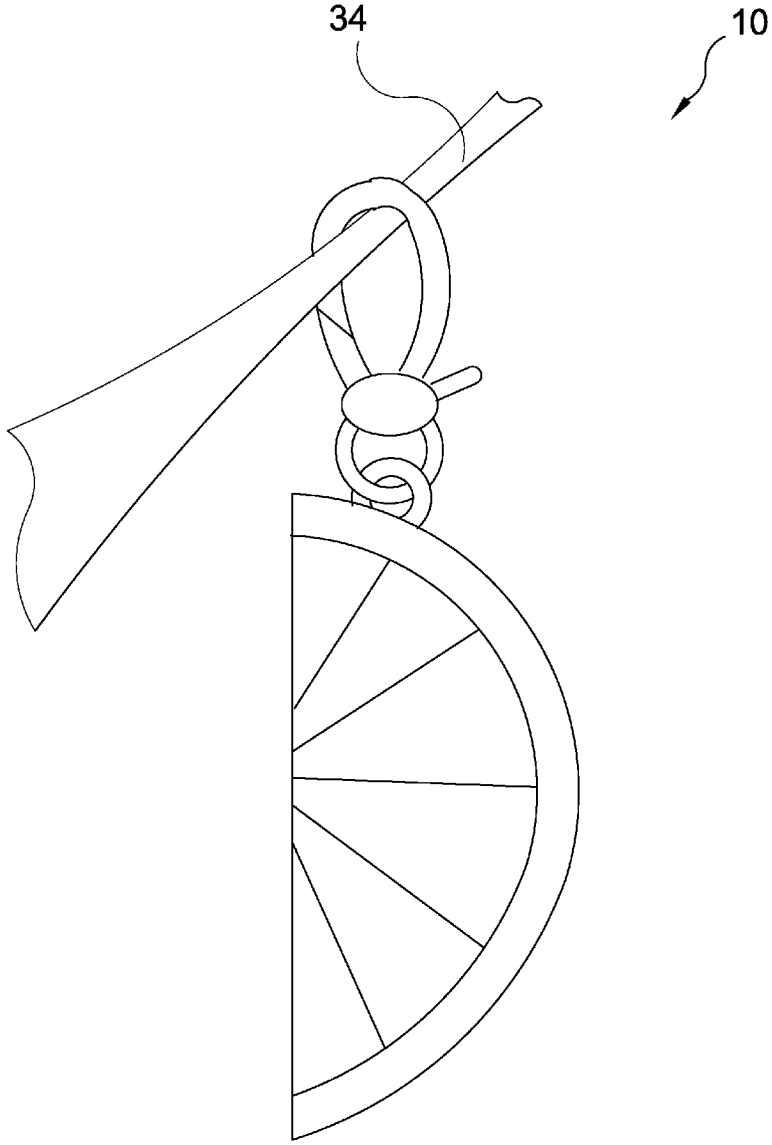
FIG. 7 is a detailed illustrative view of the decorative ornament and clasp in use with a horizontal structure of thong underwear.

FIG. 7 is a detailed illustrative view of the decorative ornament and clasp 10 in use with a horizontal structure of thong underwear or bikini bottoms 34.

Figure 8:
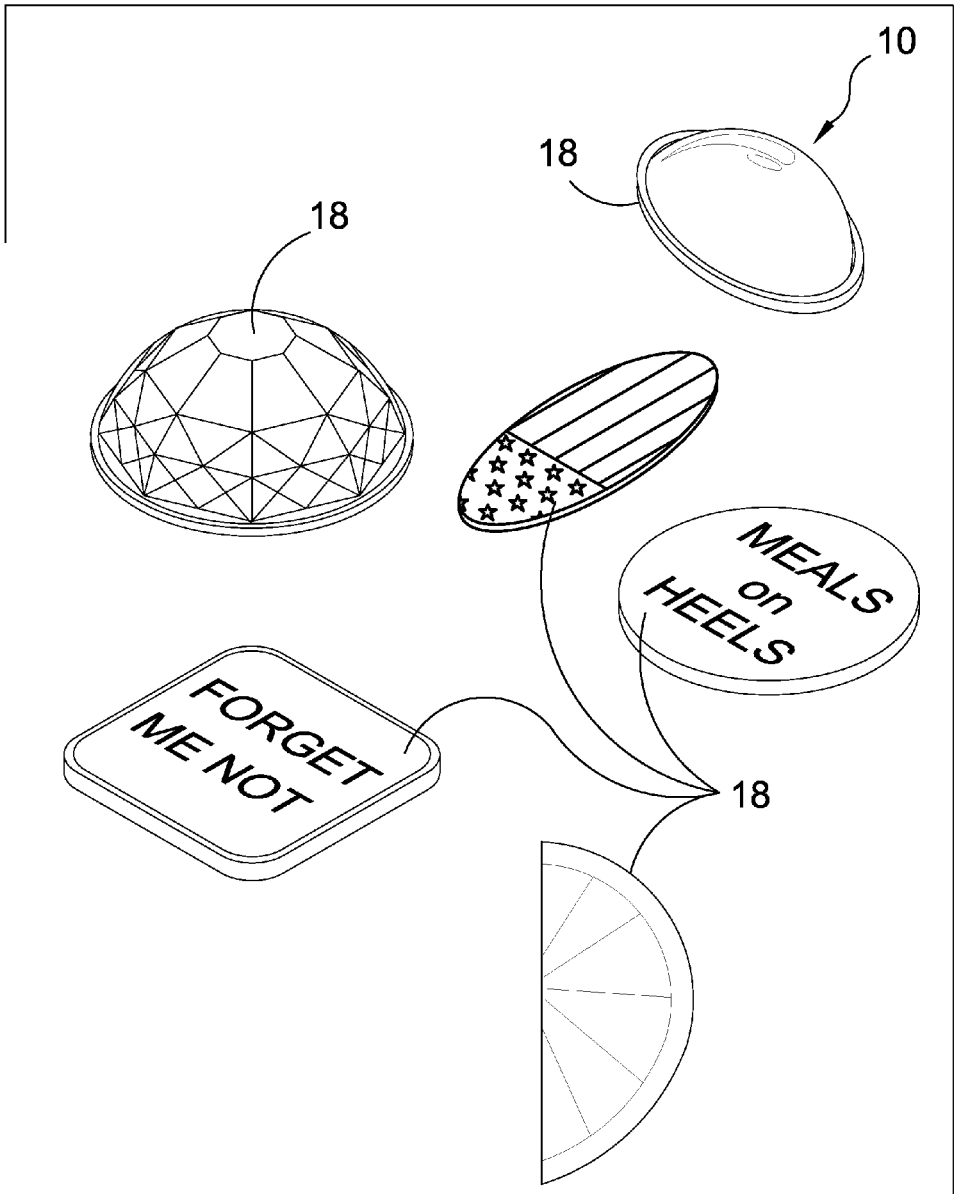
FIG. 8 is a perspective view of additional decorative article designs provided by the present invention.

FIG. 8 is a perspective view of additional decorative article 18 designs provided by the present invention 10. Shown is the decorative article 18 having a plurality of shapes and sizes and materials by which the decorative pendant can be manufactured.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method of indicating which breast of a nursing mother is to be suckled next involving the steps of:

a) providing a nursing bra with a pair of shoulder straps;

b) providing an indicator, the indicator including: a decorative ornament hanging from a parrot clasp, the parrot clasp including: a hook portion, a clasp portion and a release trigger;

c) providing a pair of flexible sheets forming releasable fastening members, each having a first end and a second end having mating hook and loop fasteners disposed thereon;

d) wrapping each said fastening members around a respective one of said pair of shoulder straps and securing them thereto with said hook and loop fasteners;

e) depressing said release trigger to form a gap between said clasp portion and said hook portion of said parrot clasp;

f) placing said hook portion over one of said releasable fastening members to indicate the breast to be suckled next;

g) releasing the trigger to close the gap between said hook and said clasp;

h) nursing said infant from the indicated breast; and i) moving said indicator to the releasable fastener member on the other shoulder strap.

2. The method according to claim 1, wherein a plurality of decorative ornaments are available to enable the user to accessorize with the outfit of the day.

3. A breast feeding indicator in combination with a nursing bra, the combination consisting of:

a nursing bra with a pair of shoulder straps;

a pair of releasable fastening members, one secured to each of said shoulder straps, each releasable fastening member is a flexible sheet having a first end and a second end, each said end having mating fasteners, said mating fasteners are hook and loop fasteners;

a breast feeding indicator including:

a parrot clasp, the parrot clasp including:

a hook portion;

a pivoting, spring-loaded clasp portion wherein a bias is presented to urge said clasp portion against said hook portion;

a release trigger to overcome said bias applied to said clasp portion to provide a gap therebetween;

a ring with a decorative article secured thereto; and said hook portion of said parrot clasp attached to one of said pair of releasable fastening members to indicate to the last breast employed for nursing.

* * * * *